United States Patent [19]

Henriksson

[11] Patent Number: 4,563,938

[45] Date of Patent: Jan. 14, 1986

[54] PRESSURE FLUID OPERATED PERCUSSIVE TOOL

[75] Inventor: Stig R. Henriksson, Nacka, Sweden

[73] Assignee: Atlas Copco Aktiebolag, Nacka, Sweden

[21] Appl. No.: 633,190

[22] Filed: Jul. 23, 1984

[30] Foreign Application Priority Data

Aug. 1, 1983 [SE] Sweden ..... 8304210

[51] Int. Cl.[4] ..... F01B 15/02

[52] U.S. Cl. ..... 91/25; 91/217; 91/276; 91/321; 173/134

[58] Field of Search ..... 91/276, 217, 25, 321; 173/134, 116, 125

[56] References Cited

U.S. PATENT DOCUMENTS 303,344 8/1884 Uren ..... 91/217
526,342 9/1894 Carlinet ..... 91/276
996,889 7/1911 Schumacher ..... 91/217
3,060,894 10/1962 Dean, Jr. et al. ..... 91/276

FOREIGN PATENT DOCUMENTS 2221555 11/1973 Fed. Rep. of Germany ..... 91/276

*Primary Examiner*—Paul E. Maslousky
*Attorney, Agent, or Firm*—Frishauf, Holtz, Goodman & Woodward

[57] ABSTRACT

A cylinder (15) is reciprocable in the housing (11) of a hydraulic percussive tool and a piston hammer (16) is reciprocable in the cylinder. The force between the cylinder and the housing is constant during the cycle of reciprocation and as a result the housing (11) is practically not vibrating at all. The piston hammer (16) and the cylinder (15) are coupled together to move conjointly during a part of each forward stroke of the hammer piston, which ensures the timing of the reciprocation of the hammer piston 16 and the cylinder (15).

6 Claims, 8 Drawing Figures

Fig.1
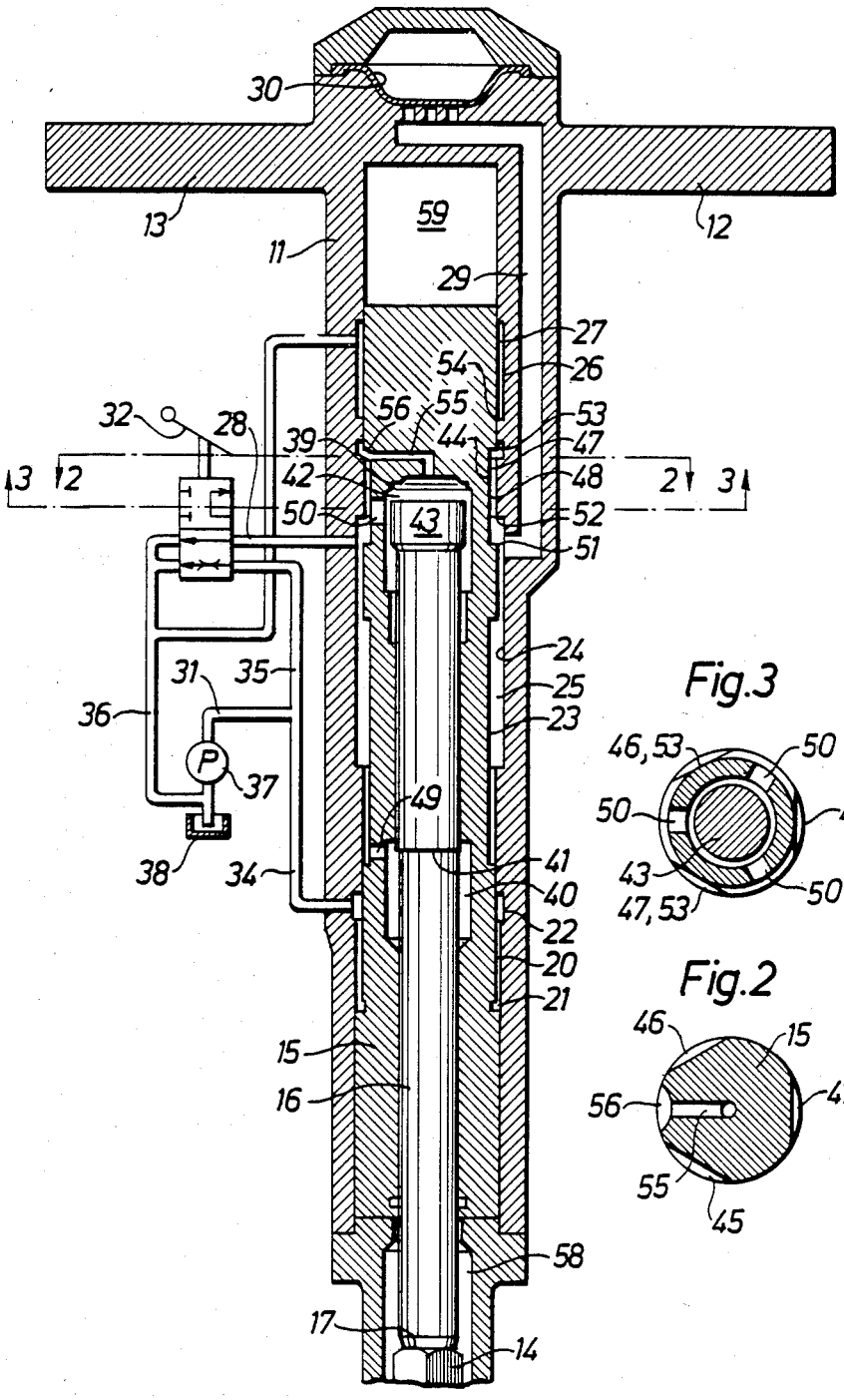
Fig.3
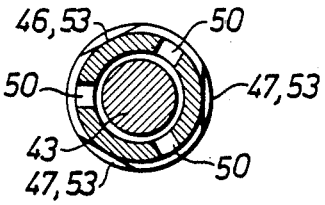
Fig.2

PRESSURE FLUID OPERATED PERCUSSIVE TOOL

BACKGROUND OF THE INVENTION

This invention relates to a pressure fluid operated percussive tool comprising a housing, a cylinder reciprocable in the housing, a piston hammer reciprocable in the cylinder and arranged to impact upon an anvil element coupled to a work implement, e.g. a chisel or a rock drill, a constantly pressurized chamber between the housing and the cylinder for biasing the cylinder forwardly in the housing, a first chamber for urging the piston hammer rearwardly in the cylinder, a periodically pressurized and vented second chamber between the piston hammer and the cylinder for urging the piston forwardly in the cylinder, and valve means for controlling the supply and venting of said second chamber in response to the axial position of the cylinder in the housing.

A percussive tool of this kind is described in U.S. Pat. No. 3,060,894, and it has an anvil element that extends into a periodically pressurized chamber. The rear end of a drill string constitutes the anvil element. Thus, the periodic fluid pressure results in a periodic force on the drill string and the forward force on the drill string will be unnecessarily high. This is a great disadvantage since it increases the feed force that must be applied to the housing of the tool. This feed force applied to the housing must balance the sum of the force exerted by the work implement on the work, for example on the pavement to be broken, and the internal reaction forces to the driving of the piston hammer. The feed force is usually the dimensioning factor and this is particularly true for hand held percussive tools.

In the percussive tool described in U.S. Pat. No. 3,060,894, there is no feed back from the piston to the valve, that is, to the cylinder that also forms a valve. Thus, there is a risk that the piston hammer and the cylinder run out of pace with each other particularly if the piston hammer receives a great rebounce energy when hitting the anvil, which occasionally occurs. It is an object of the invention to provide a pressure fluid operated vibration damped percussive tool in which the ratio between the impact power and the necessary feed force is high. It is also an object to provide a percussive tool of this kind in which the piston hammer and the cylinder do not tend to run out of pace with each other.

BRIEF DESCRIPTION OF THE DRAWINGS

FIG. 1 is a longitudinal section through a percussive tool according to the invention.

FIGS. 2 and 3 are transverse sections taken on lines 2—2 and 3—3 respectively through a cylinder shown in FIG. 1.

DETAILED DESCRIPTION

Figure 4:
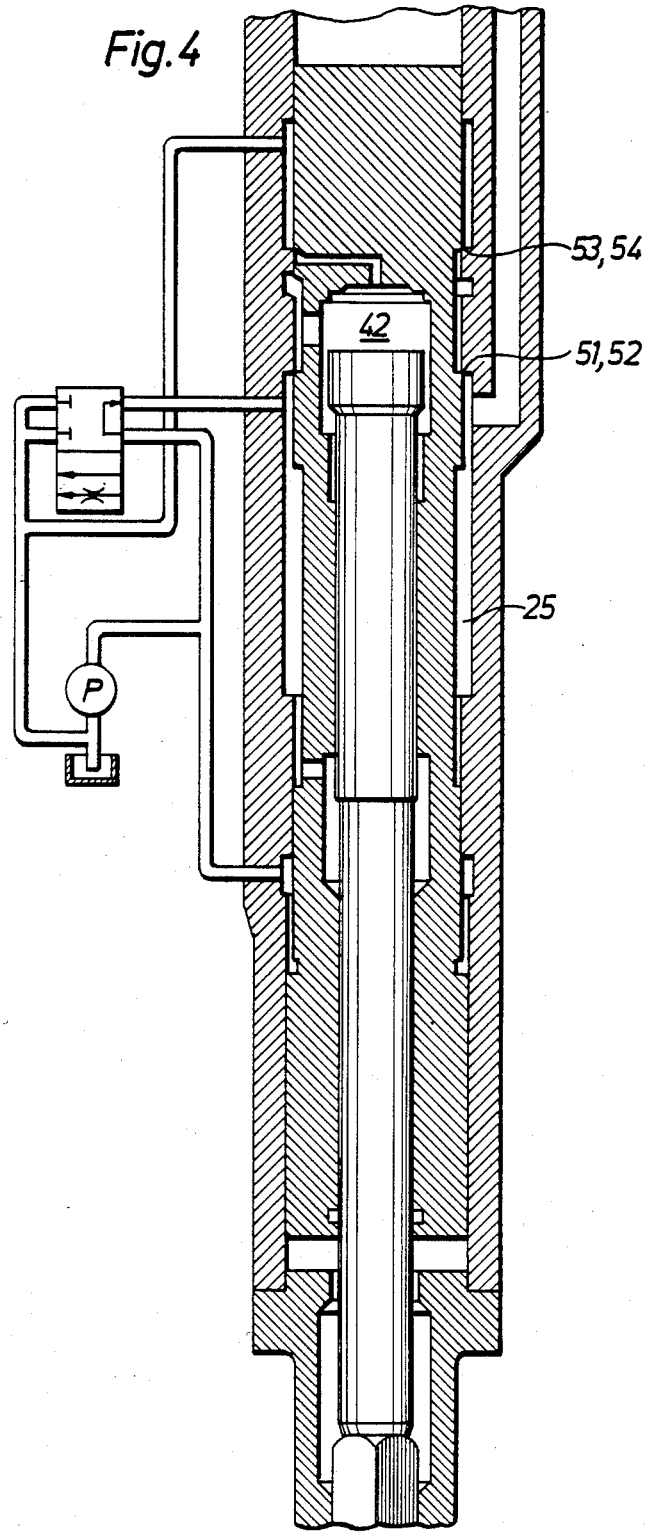
FIGS. 4–8 are longitudinal sections that correspond to FIG. 1 but show movable elements in other relative positions.

The percussive tool shown in the drawings is a hydraulically operated hand-held breaker. It comprises a housing 11 with handles 12, 13. A hexagonal shank 14 of a work implement in the form of a chisel is inserted into the front end of the housing 11 and retained there by a suitable conventional non-illustrated means. A non-illustrated collar on the chisel abuts against the housing 11 in a conventional way so that a feed force can be transmitted from the housing to the chisel and so that the chisel will have a defined axial position in the housing. The housing 11 forms a cylinder for a cylinder 15 for a piston hammer 16 that is arranged to impact on the end face 17 of the shank 14. Thus, the shank 14 of the chisel forms an anvil for the piston hammer 16. An annular pressure chamber 20 is formed between the housing 11 and the cylinder 15. The diameter of the sliding surfaces forwardly of the chamber 20 is larger than the diameter of the sliding surfaces rearwardly of the chamber 20 and thus, the pressure in the chamber 20 acts on the annular surface 21 of the cylinder 15 to urge the cylinder 15 forwardly and a corresponding reaction force is applied to the annular surface 22 of the housing 11 to urge the housing rearwardly. Two annular recesses 23, 24 in the cylinder 15 and the housing 11 respectively form an inlet chamber 25, and a recess 26 in the housing 11 forms an outlet chamber 27. A nitrogen charged diaphragm accumulator 30 is constantly coupled to the inlet chamber 25 via a passage 29. A supply valve 31 is schematically shown. It has a lever 32 by which it can be actuated. The lever 32 is in fact mounted on the handles 12,13 and the valve 31 is affixed to the housing 11.

A supply conduit 33 from a pump 37 has a branch 34 to the chamber 20 and a branch 35 to the valve 31. A passage 28 connects the supply chamber 25 with the valve 31. The outlet chamber 27 is constantly coupled to a tank 38 through a return conduit 36. In FIG. 1, the valve 31 is in its off-position in which it couples the supply chamber 25 to the return conduit. It its off-position, the valve 31 leaks oil directly from the supply conduit 33,35 to the return conduit 36 in order to provide for the cooling of the pump 37. Between the piston hammer 16 and the cylinder 15, there is an annular chamber 40 for urging the piston hammer 16 rearwardly by the pressure acting on an annular surface 41 of the piston hammer. This chamber 40 is constantly connected to the supply chamber 25 by means of three bores 49 through the cylinder 15. Another chamber 42 is formed around a head 43 of the piston hammer 16 for urging the piston hammer 16 downwardly against the force applied by the pressure in the chamber 40. A rear cylindrical portion 39 of the chamber 42 forms a cylinder for the piston head 43.

An annular recess 44 in the cylinder 15 has three rearward extensions in the form of three flats 45,46,47. The recess 44 and its extensions 45,46,47 form a valving chamber 48. The edges 51,52 of the recesses 44,24 form together an inlet valve for the chamber 42. Three bores 50 provide a communication between the valving chamber 48 and the chamber 42. The edges 53 of the three flats 45–47 and the edge 54 of the recess 26 form together an outlet valve for the chamber 42. The distance between the edges 52,54 equals the distance between the edges 51,53. A trigger passage 55 leads from a milled slot 56 between the two flats 45,46 to the end of the chamber 42. Two chambers 58, 59 in front of and at the rear of the cylinder 15 are vented to the atmosphere. The operation of the percussive tool will now be described.

Figure 5:
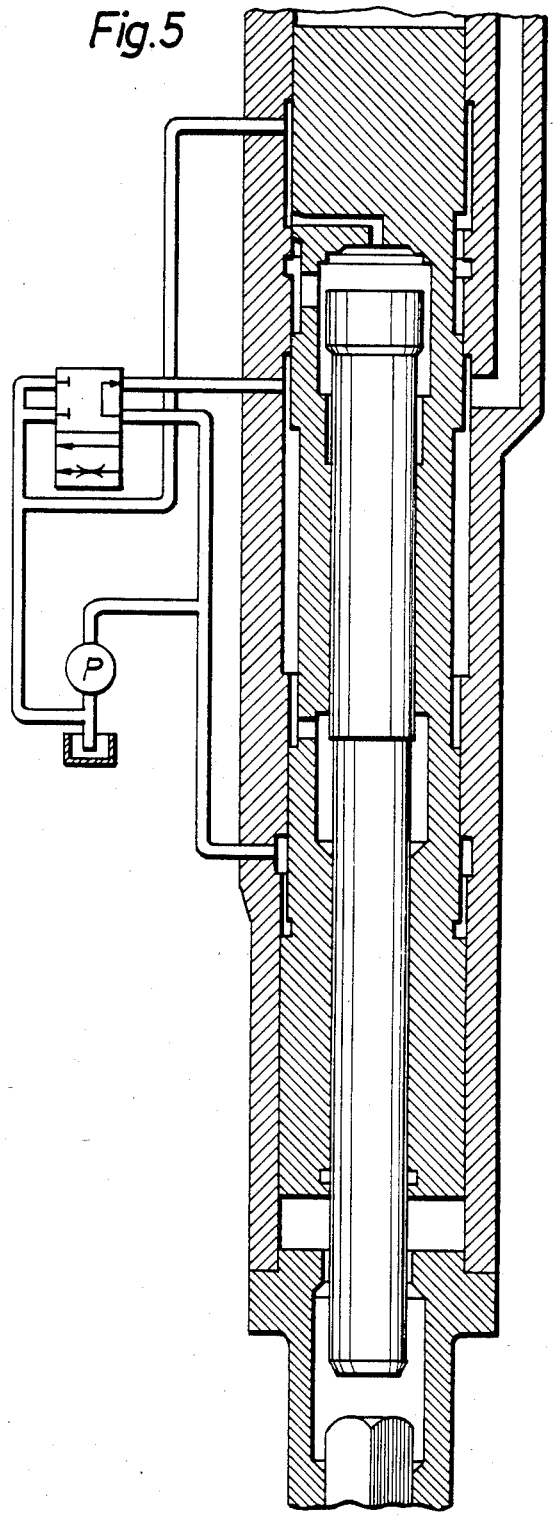
Figure 6:
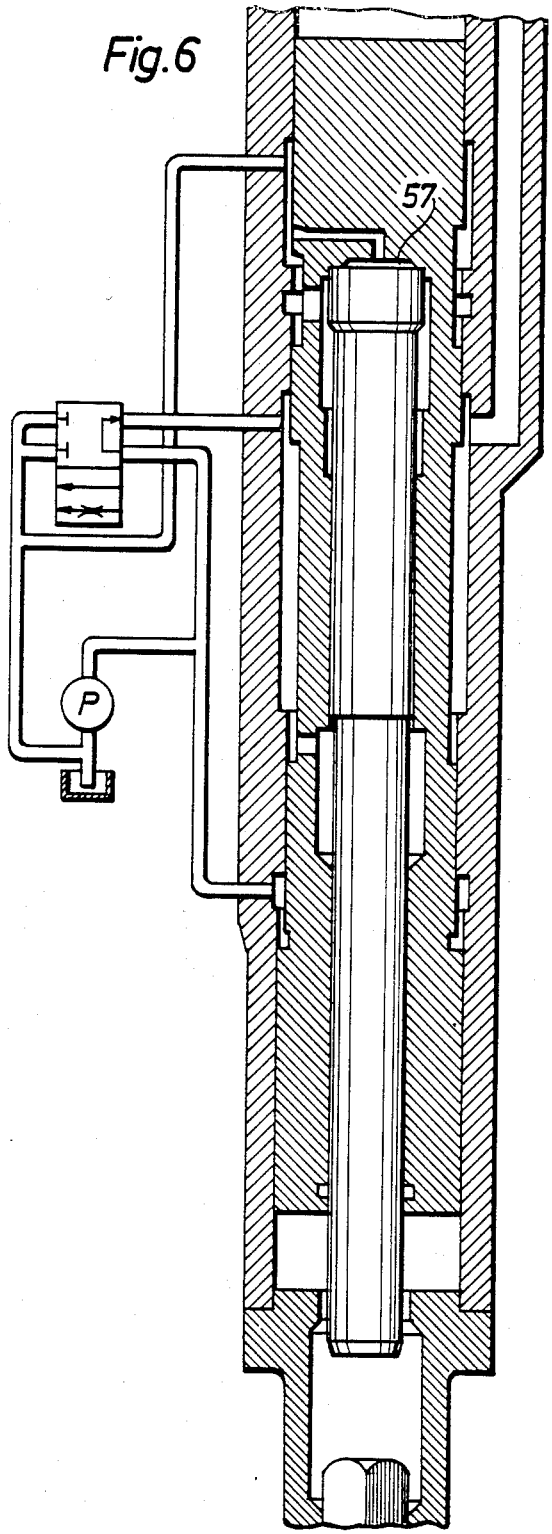
Figure 7:
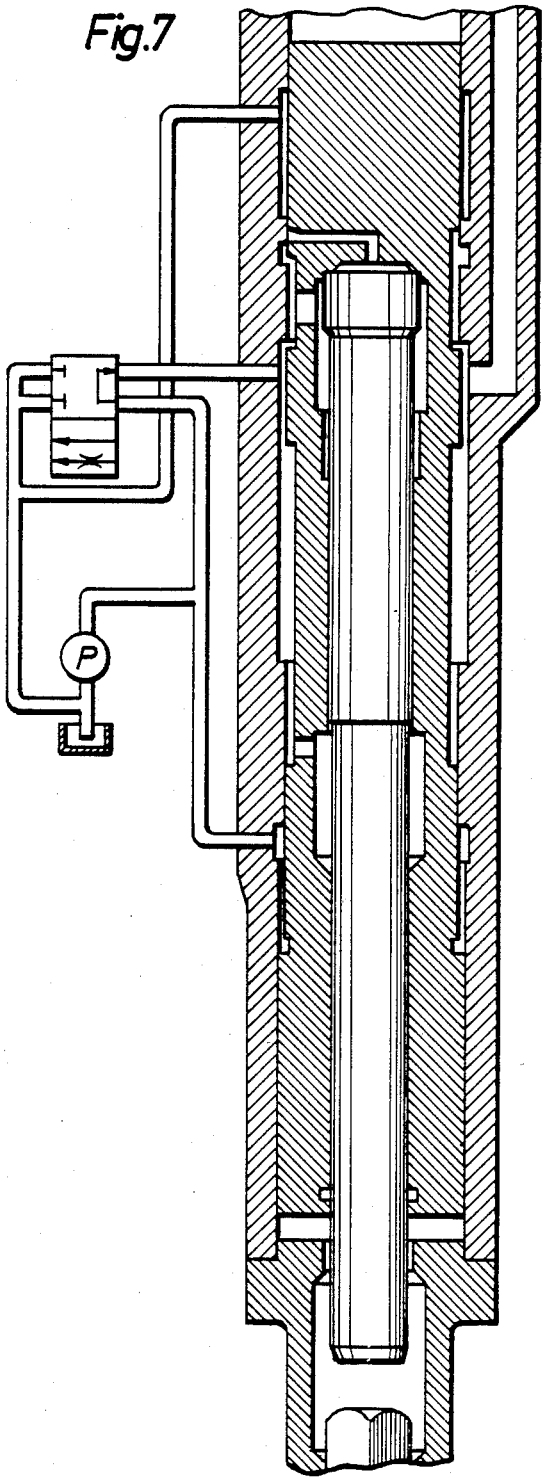

When the pump 38 is operating and the valve 31 is in its off-position in which it is shown in FIG. 1, the cylinder 15 is in its foremost position because of the pressure in the chamber 20. When the valve is switched into its operating position in which it is shown in FIGS. 4–8, the inlet chamber 25 and the chamber 40 become constantly pressurized. The valving chamber 44 is pressurized from the inlet chamber 25 and, thus, the chamber 42 is also pressurized so that the cylinder 15 starts moving backwardly. The piston hammer 16 remains forced against the chisel 14. When the cylinder 15 reaches its position in FIG. 4, the edges 51,52 close the inlet from the inlet chamber 25 to the chamber 42 and the edges 53,54 open the outlet from the chamber 42 to the outlet chamber 27. When the chamber 42 is thus depressurized, the biassing force on the annular surface 41 of the piston hammer accelerates the piston hammer 16 rearwardly as can be seen in FIG. 5 and the biassing force on the annular surface 21 of the cylinder 15 decelerates the cylinder 15. However, the cylinder 15 moves on backwardly due to its inertia and it will turn and start its forward movement when it is about the position in which it is shown in FIG. 6. The head 43 of the piston hammer 16 will move into the cylindrical portion 39 of the chamber 42 as can be seen in FIG. 6 and shut off a top portion 57 of the chamber 42 from the remainder of the chamber 42, and since the trigger passage 55 is open to the outlet chamber 27, the piston hammer 16 will remain coupled to the cylinder 15 due to the biassing force on its surface 41. The piston hammer 16 will be coupled to the cylinder 15 when the cylinder turns or shortly before or after the turning.

Figure 8:
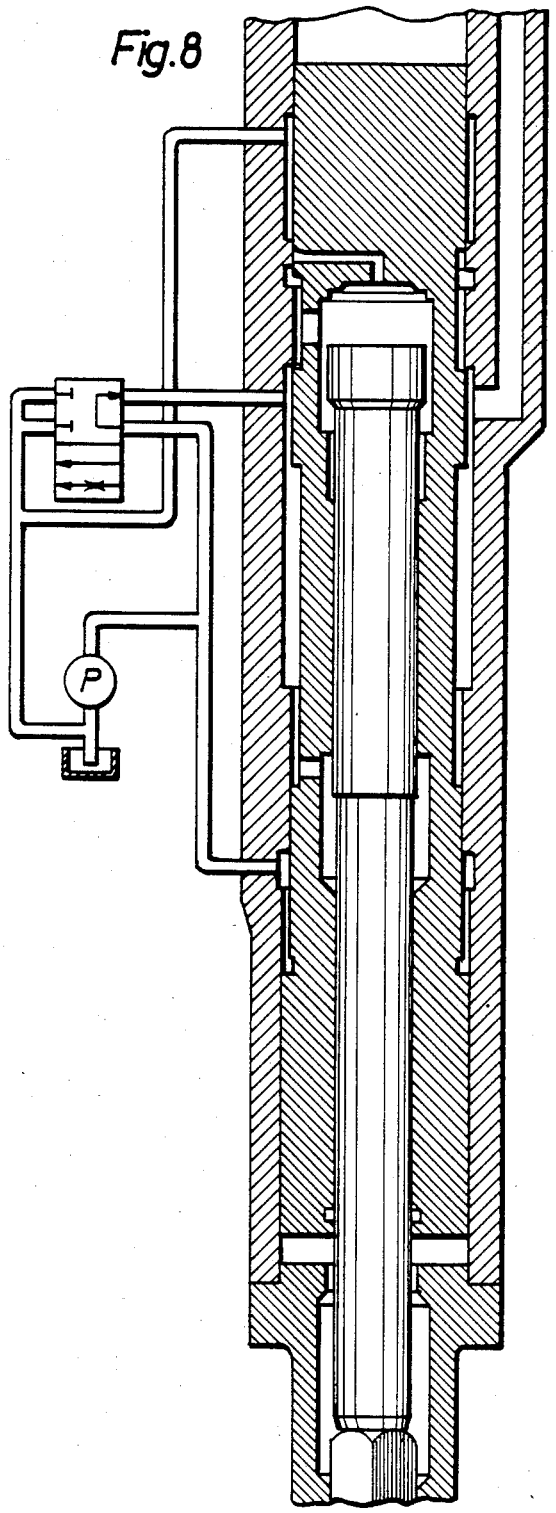

Then, when the cylinder 15 moves forwardly, it brings the piston hammer 16 with it and when the cylinder chamber 42 is again pressurized the piston hammer 16 remains coupled to the cylinder 15 since the top chamber 57 is still depressurized. When the cylinder 15 reaches its position of FIG. 7 shortly after the pressurization of the cylinder chamber 42, the trigger passage 55 becomes open to the valving chamber 48 and thus pressurized, and the pressure in the top chamber 57 forces the piston hammer 16 out of its cylinder portion 39 at a comparatively low speed due to the low capacity of the trigger passage. Thus, the inlet valve formed by the edges 51,52 will be fully open when the piston hammer 16 moves out of its cylinder portion 39 and the piston hammer 16 will start its forward acceleration very distinctly. The cylinder 15 turns and starts its rearward movement because of the pressure in chamber 42 and when the piston hammer 16 impacts on the chisel, the cylinder is very close to its position in which the edges 51,52 close the supply to the chamber 42 and the edges 53,54 open the chamber 42 to drain as can be seen in FIG. 8. Due to the depressurization of the chamber 42 that thus occurs almost simultaneously with the impact, the piston hammer 16 starts its rearward movement and the cylinder decelerates as in FIG. 5 so that the sequence of FIGS. 5–8 is repeated.

The cylinder 15 shall be at least 5 times as heavy as the piston 16 and preferably about at least 10 times as heavy and its movement will therefore be slow. The timing of the coupling together of the hammer piston 16 and the cylinder 15 is not critical and will vary somewhat due to the properties of the work which can be sticky asphalt pavement or hard rock.

During operation, the only fluid force on the housing 11 is the force on the surface 22 in the constantly pressurized chamber 20. Since the diameters of all sliding surfaces rearwardly of the chamber 22 are equal, the valving action for pressurizing and depressurizing the chamber 42 will not exert any fluctuating resultant force on the housing; there will in fact be no resultant force at all. Thus, there is only one constant fluid force on the housing and this force is to be matched by the sum of he weight of the housing and the feed force applied to the housing, i.e. applied to the handles 12,13. A few tenths of Newtons more should be applied to the handles 12,13 in order to force the chisel against the work and prevent its recoil.

As described, the cylinder 15 and the piston hammer 16 move conjointly during a part of each cycle of operation and, thus, they can not run out of their timed relationship even if the piston hammer receives a great rebounce from the chisel which occasionally occurs. The trigger passage 55 is not absolutely necessary, but it results in a more distinct control of the timing. Thus, the trigger passage can be dispensed with and also other modifications can be made within the scope of the claims. For example, the cylinder 15 can be used as a pilot valve that controls a separate valve that controls the flow to the chamber 42.

Although a hand held breaker is illustrated, the invention can be applied to other kinds of percussive tools, such as hand held rock drills and larger rock drills and breakers.

I claim:

1. A pressure fluid operated percussive tool comprising:

a housing (11);

a cylinder (15) reciprocable in said housing (11) in an axial direction of said cylinder;

a piston hammer (16) reciprocable in said cylinder (15) and arranged to impact upon an anvil surface (17) coupled to a work implement (14);

a constantly pressurized chamber (20) between said housing (11) and said cylinder (15) for biassing said cylinder (15) forwardly in said housing (11);

a first chamber (40) for urging said piston hammer (16) rearwardly in said cylinder (11);

a periodically pressurized and depressurized second chamber (42) between said piston hammer (16) and said cylinder (15) for urging said piston hammer (16) forwardly in said cylinder (11);

an inlet (28) which is constantly pressurized during operation of said tool;

an inlet chamber (25) formed between said housing and said cylinder (15) and which is constantly coupled to said inlet (28);

an outlet chamber (27) formed between said housing (11) and said cylinder (15) at the rear of said inlet chamber (25) and which is constantly coupled to an outlet (36);

valve means comprising a valving chamber (48) located intermediate said inlet and outlet chambers (25,27) and which is arranged to be alternatively coupled to said inlet and outlet chambers (25,27) in response to the axial position of said cylinder (15) in said housing (11), said valving chamber (48) being constantly connected to said second chamber (42) by means of a passage (50) through said cylinder (15);

said piston hammer (16) being arranged to close off a rear end portion (57) of said second chamber (42) from said passage (50) from said valving chamber (48) when said piston hammer (16) reaches a rear end position in said cylinder (15);

a trigger passage (55) leading between said rear end portion (57) of said second chamber (42); and a triggering valve means (56) formed between said housing (11) and said cylinder (15) and which is arranged to alternatively pressurize and drain said trigger passage (55), said triggering valve means

(56) being arranged to pressurize said trigger passage (55) only when said cylinder (15) is forwardly of a position which is a predetermined distance forwardly of the position in which said valving chamber (48) is opened to said inlet chamber (25).

2. The pressure fluid operated percussion tool of claim 1, wherein said first chamber (40) is defined solely by said piston hammer (16) and said cylinder (15).

3. The percussive tool of claim 1, wherein said valve means includes means for controlling the reciprocation of said cylinder (15) and said piston hammer (16) such that said piston hammer (16) and said cylinder (15) are coupled together to move conjointly during a part of each cycle of operation.

4. The percussive tool of claim 1, wherein said valve means includes cooperating shoulders and recesses (51–54) in said housing (11) and on said cylinder (15).

5. The percussive tool of claim 1, wherein said triggering valve means (56) is arranged to alternatively open said trigger passage (55) to said valving chamber (48) and to said outlet chamber (27).

6. A pressure fluid operated percussive tool comprising: a housing (11);

a cylinder (15) reciprocable in said housing (11) in an axial direction of said cylinder;

a piston hammer (16) reciprocable in said cylinder (15) and arranged to impact upon an anvil surface (17) coupled to a work implement (14);

a constantly pressurized chamber (20) between said housing (11) and said cylinder (15) for biassing said cylinder (15) forwarding in said housing (11);

a first chamber (40) for urging said piston hammer (16) rearwardly in said cylinder (11);

a second chamber (42) between said piston hammer (16) and said cylinder (15) for urging said piston hammer (16) forwardly in said cylinder (11);

a valving means (48, 51–54) for controlling the supply and exhaust of at least one of said first and second chambers for controlling the reciprocation of said cylinder (15) in said housing (11) and the reciprocation of said piston hammer (16) in said cylinder (15);

said valving means comprising cooperating parts (51–54) of said cylinder (15) and said housing (11); and said valving means (48, 51–54) being arranged to control the reciprocation of said cylinder (15) and said piston hammer (16) such that said piston hammer (16) and said cylinder (15) are coupled together in axial engagement to move conjointly in the forward direction during a part of each cycle of operation of the tool and separated again to cause the piston hammer to move forward ahead of the cylinder when the cylinder reaches a predetermined axial position during its forward stroke.

* * * * *